US005398852A

United States Patent [19]

Lacy

[11] Patent Number: 5,398,852

[45] Date of Patent: Mar. 21, 1995

[54] TANK PRESSURIZATION CAP

[76] Inventor: Johnson W. Lacy, 13309 Teasdale Ct., Richmond, Va. 23233

[21] Appl. No.: 115,992

[22] Filed: Sep. 2, 1993

[51] Int. Cl.[6] ..... B67D 5/42

[52] U.S. Cl. ..... 222/386.5; 222/464; 239/323

[58] Field of Search ..... 222/105, 95, 183, 386.5, 222/389, 395, 464; 239/323

[56] References Cited

U.S. PATENT DOCUMENTS

| | | | |
|---|---|---|---|
| 1,731,767 | 10/1929 | Cramer | 222/386.5 |
| 1,939,611 | 12/1933 | Purvis | 222/395 UX |
| 2,063,430 | 12/1936 | Graser | 222/386.5 |
| 2,105,160 | 1/1938 | Piquerez | 222/386.5 |
| 2,513,455 | 7/1950 | Cornelius | 222/386.5 |
| 2,723,161 | 11/1955 | Covington | 222/386.5 |
| 2,865,541 | 12/1958 | Hicks | 222/386.5 |
| 3,184,113 | 5/1965 | Curtis | 222/386.5 |
| 3,662,929 | 5/1972 | Sims | 222/386.5 |
| 3,756,367 | 9/1973 | Mitchell et al. | 222/386.5 X |
| 4,067,485 | 1/1978 | Soin | 222/386.5 |

*Primary Examiner*—Kevin P. Shaver

[57] ABSTRACT

A unitary pressurizing tank cap used for direct substitution of existing manual pump spray closures. The tank cap connects to a standard garden hose and uses household water pressure to pressurize a tank's contents. The cap includes a flexible bladder for insertion into the tank. The cap further includes a handle which can be used for carrying the tank and screwing and unscrewing the cap.

13 Claims, 3 Drawing Sheets

TANK PRESSURIZATION CAP

This invention relates to pressurization spray tanks used to spray liquid fertilizer, insecticides, and other liquid and especially relates to small, portable spray tanks of the kind often used around homes or for light industrial applications.

BACKGROUND OF THE INVENTION

A wide variety of liquid dispensing devices that are pressurized to expel the liquid and are of a portable size are presently available on the market and in the literature. An especially common type of portable sprayer widely distributed by garden and hardware stores is a type that has a main opening located at the top and a second opening located on the side. The second opening is small and connected to a hose for spraying the chemical or liquid from the tank under pressure. The main opening is relatively large and the liquid to be dispensed is poured into the container through this opening. The opening is then closed by a cap that is screwed into the opening and includes a hand-pump integral therewith. The hand pump is used to supply air pressure to the inside of the tank to pressurize the liquid to be dispensed therefrom through the small opening and its hose and nozzle. As the liquid is dispensed from the tank, the pressure declines and it is necessary that the hand pump be operated to rebuild the pressure.

SUMMARY OF THE INVENTION

The present invention provides a unique unitary tank pressurization cap that may be directly substituted for the previous tank cap that has an integral hand pump. The tank cap of the present invention has a threaded fitting to attach the new cap to the preexisting tank. The new cap has a passageway therethrough with the inside end of the passage way attached to a flexible bladder, preferably made from rubber, that is of a sufficient size to completely fill the tank when expanded but of a diameter when deflated to enable it to be readily inserted into the tank through the opening at the top thereof. The upper and outboard end of the passageway in the cap is attached to a coupler from a standard garden hose. When the liquid to be dispensed, such as a insecticide or fertilizer, is placed in the tank, the collapsed flexible bladder is inserted through the main opening into the tank and held in place by the unitary tank cap as it is rotated and locked on to the tank along with the garden hose coupler carried therewith as a unitary structure. Next, when the liquid is to be dispensed, the garden hose coupler is connected with a standard garden hose which in turn is connected to a supply of water from the utility company or well at standard household water pressure and the valve opened so that the water flows through the coupling and the passageway in the unitary tank pressurization cap to fill and inflate the flexible bladder which expands against the liquid in the container until the pressure exerted thereagainst is equal to the water line pressure. The tank remains connected to the water line pressure as the contents are dispensed through the hose and nozzle. As this dispensing takes place additional water under pressure enters the flexible bladder to continue to expand it to maintain the pressure on the liquid. If it is desired to dispense the liquid beyond the reach of the garden hose the unitary tank pressurization cap with the flexible bladder and hose connector may be removed and the original cap with hand pump may be reinstalled and utilized for those areas.

The new invention enables the use of the sprayer as a water pressurized sprayer when a large volume of liquid is dispensed within the range lengthwise of a suitable water hose such as a garden hose and the hand pumped mode for small tasks and when removed from the garden hose. The invention is simple in design and manufacture and is simple and handy in use. The tanks that use hand-pumped air pressure for dispensing are usually pumped to a pressure to provide an evenly dispersed strong spray that rapidly diminishes in quality of the pattern and in the pressure providing the driving force as the liquid being dispersed reduces the initial air pressure as it leaves the tank. The tank must then be repumped repeatedly to bring the pressure back up to restore the quality of the spray. This is time consuming, laborious and often aggravating. Approximately one-third of the tank capacity of this type of tank is reserved for storage of compressed air. By eliminating the requirement for air storage the tank may increase its capacity for liquid by about 50 per cent. This is accomplished by both eliminating the initial air space and eliminating the space occupied by the air pump.

A better understanding of the details of the special features of the invention will be appreciated when with reference to the description and the accompanying drawings of the preferred embodiments are read.

BRIEF DESCRIPTION OF THE DRAWINGS

With reference to FIG. 1, there is shown a standard dispensing tank 11 having a spray hose 20 going to a spray nozzle (not shown). The hose is connected to a spray hose fitting 22 at one side of the tank. An internal pipe 24 is connected to the spray hose fitting 22 and extends to the bottom of the tank to permit the liquid therein to enter at the bottom of the internal pipe 24 to be dispensed. The liquid 26 can be any of the well known solutions or dispersants such as insecticides, fertilizers and the like that are dispensed from tanks of this nature. The top of the tank has a large opening 28 made up of a funnel portion 30 and an internally threaded portion 32. The opening 28 has the cap of this invention screwed therein. The closure cap consists of a tank connector portion 34 having external threads at the lower end thereof that are adapted to screw into the tank opening 28 and are complimentary to the internal threaded portion 32.

Figure 1:
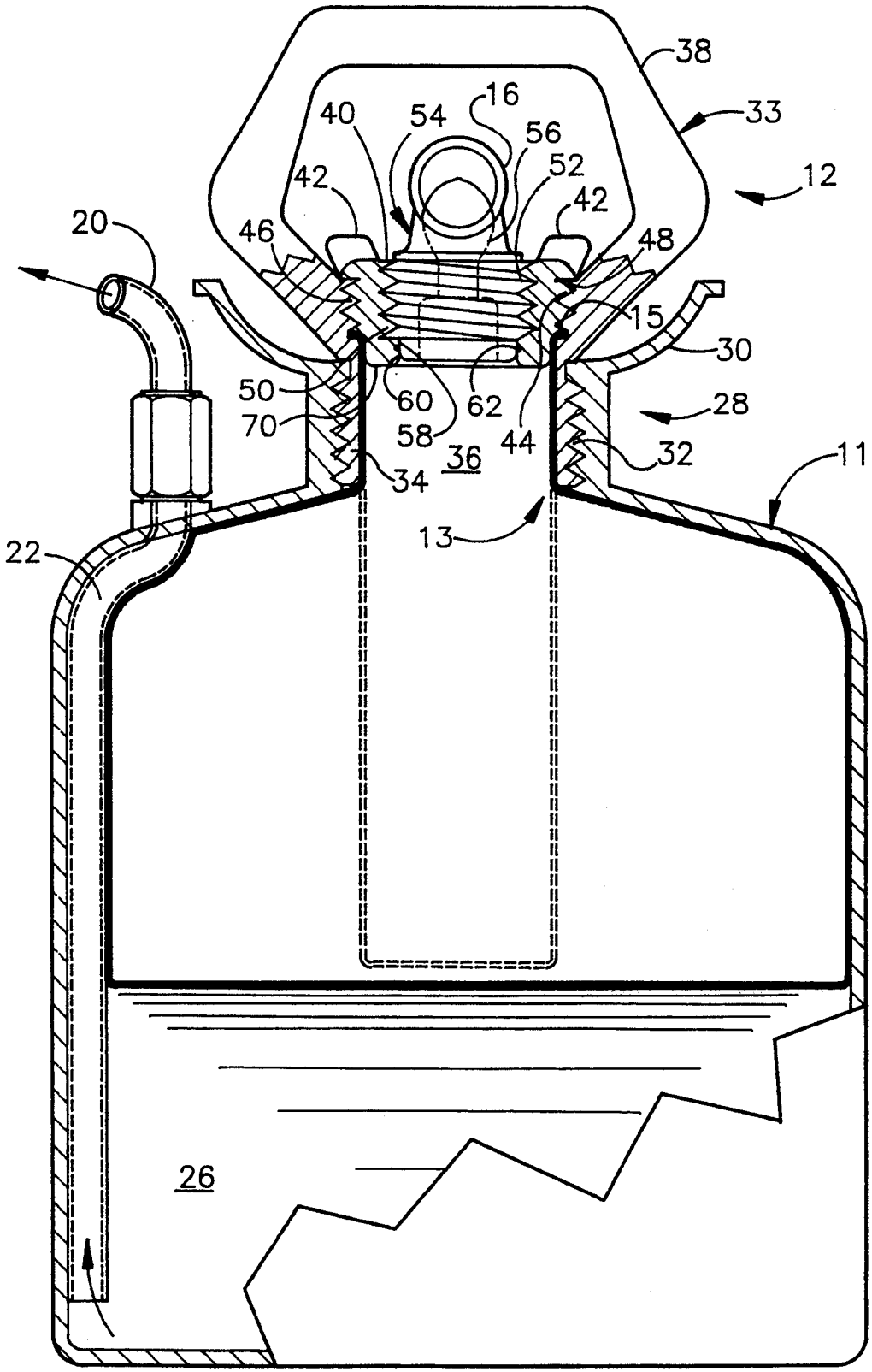
FIG. 1 is a side view of the invention shown partly cut away.

Generally the tanks have threaded connections, any similar type of mechanical connection such as a lug arrangement can be utilized. Other parts of the unitary closure cap 12 include a handle 38 integrally connected to the tank connector portion 34 and throat opening 36.

A liquid tight flexible bladder 13 is connected by a bladder neck ring 15 to the cap 12 by having the bladder neck ring captured between an internal shoulder of the handle assembly and a corresponding shoulder on the lower end of sealing plug 40.

Flexible sealing bladder 13 is preferably made of a rubber or elastomaric stretchable material which can be expanded to the full internal dimensions of tank 11 to expel all liquids therefrom. A partially expanded bladder is shown in solid lines on FIG. 1 and a non-expanded dimension is shown by the dotted lines of FIG. 1. Of course, when the bladder is first inserted in a full tank it will not only be non-stretched but would usually be collapsed to minimize its volume as well. Although, preferably, a rubber stretchable bladder is utilized, the bladder could also be made from a flexible material of a dimension that when fully expanded from a collapsed position of minimum volume the expanded bladder would fill the empty tank. This flexible material need not be stretchable such as rubber, although a rubber bladder is the preferred material.

The sealing plug 40 has at its top a series of lugs 42 spaced about the periphery and adapted to assist in screwing and unscrewing the plug. The sealing plug 40 has external threads 44 mating with internal threads 46 of the handle 38 so that when the sealing plug 40 is tightened into position to lock the bladder neck ring 15 into a liquid tight connection it is prevented from over tightening by shoulder 48 on sealing plug 40.

The sealing plug 40 also has internal threads 50 adapted to mate with external threads 52 of hose connector assembly 54. The hose connector 54 has a hose fitting plug 16, a passageway 56 which connects a hose to the interior of the bladder 13 and a lower external smooth periphery 58 adapted to provide a close fit to a smooth internal surface 60 of the sealing plug 40. The internal surface 60 contains an O-ring seal 62 to enable a liquid tight seal between the hose connector assembly 54 and the sealing plug 40. As seen in the figures the passageway has an outside opening in the hose fitting plug 16 and an inside opening within the external threads 52 of the hose connector assembly 54.

Figure 2:
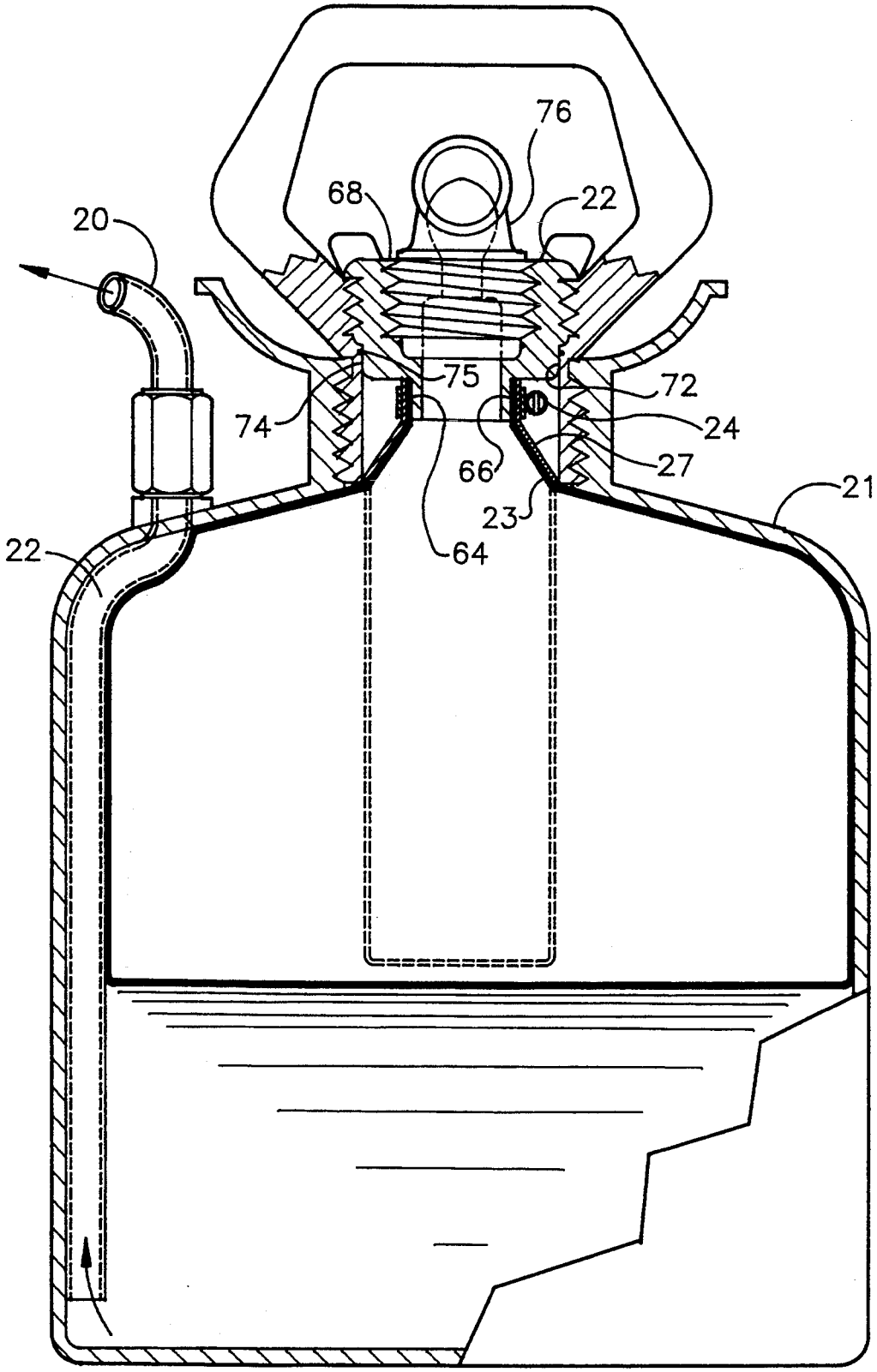
FIG. 2 is a view similar to FIG. 1 of a second embodiment on the invention.

With reference to FIG. 2 there is shown an alternative embodiment to FIG. 1 with all of the parts being similar except for the arrangement now described. There is again a standard dispensing tank 21 having a flexible bladder 23 inserted therein. The bladder 23 rather than using a bladder neck-ring at right angles to the axis of the bladder captured between a shoulder of the sealing plug and a shoulder of the top of the bladder 23 has a straight neck ring 64. This neck ring 64 is of a diameter substantially the same as the outside diameter of neck 66 of the lower portion of sealing plug 68. The neck 66 preferably has a smooth cylindrical external surface for receiving the straight neck ring 64. Surrounding the straight neck ring 64 is a collar 27 that is split (split not shown) so that it can shrink its diameter and clamp the straight neck ring 64 to the outside of the neck 66 by means of a band clamp *24a*.

The collar 27 serves to distribute the forces on the top necked down portion of bladder 23 similar to the rounded nose 70 at the lower end of the sealing plug 40 of FIG. 1. The rounded nose prevents any sharp surfaces from contacting the bladder when it collapses.

The sealing plug 68 also has an intermediate periphery 72 of a diameter approximately the same as the internal diameter of the tank connector portion 74. Carried by the intermediate periphery 72 is an O-ring seal 75.

The hose connector assembly 76 is identical to the hose connector assembly 16 of FIG. 1.

Figure 4:
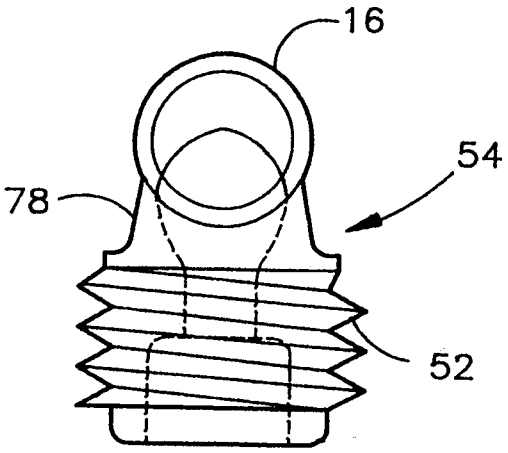
FIG. 4 is a side view of FIG. 3.
Figure 3:
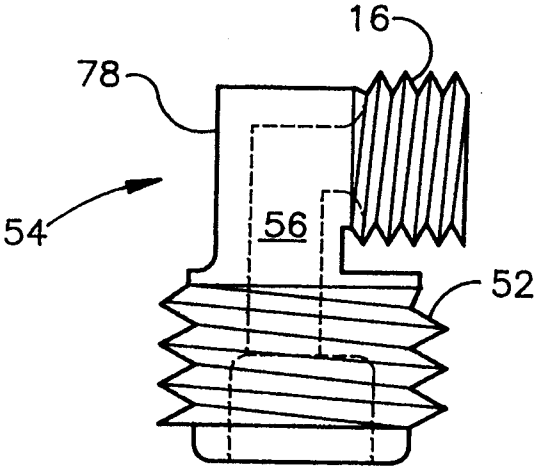
FIG. 3 is an elevational view of the hose connector component.

With reference to FIGS. 3 and 4 there is shown the hose connector assembly 54 which is the same as the hose connector assembly 76 of FIG. 2. The hose connector assembly 54 has a lower external thread 52 which screws into the internal threads 50 of the sealing plug 40.

Married to the lower threaded portion is an upright riser 78 which carries the hose fitting plug 16 at a right angle to the axis of external threads 52.

The external threads of hose fitting plug 16 marry with a common garden hose either directly or through an intermediate fitting to tap into the hydraulic water line pressure to fill the bladder with pressurized water which provides the propelling force for any liquid to be dispensed from the tank. Passageway 56 connects the hose fitting plug through the upright riser 78 and through the lower threaded portion into the bladder.

Thus, there has been described a pressure tank closure assembly that may be substituted directly for existing manual air pump closure assemblies. The new assembly includes a flexible bladder for pressurizing the contents of a standard tank attached to a handle tank connector 33 which carries a sealing plug 40 and hose connector assembly 54 as a unitary assembly.

In is to be understood that the following claims are intended to cover the features of the invention herein described. It is to be further understood that the specific embodiment and alternative embodiment shown is not to be construed in the limiting sense but rather to depict and illustrate the principles of the present invention. Modifications may be made by those with skill in the art which will not depart from the spirit or scope of the protection set forth in the following claims.

What is claimed is:

1. A unitary pressurizing tank closure assembly for a portable sprayer apparatus comprising:

a closure cap assembly having a passageway therethrough for attachment to a fill opening of a dispensing tank;

a flexible bladder having a neck associated with said closure cap assembly and of a size when collapsed to fit into and be inserted into the fill opening of the tank and with an expanded size to fill the tank;

a handle associated with said closure cap assembly for carrying the tank;

said cap assembly comprises a connector affixed to said handle and having screw threads for attachment into the tank which are adapted to be screwed and unscrewed by said handle; and a hose connector assembly attached to said closure cap assembly as a part thereof and having an external attachment end for attaching to a water hose.

2. The unitary pressurizing tank closure assembly of claim 1, wherein said flexible bladder is made of an elastomeric material.

3. The unitary pressurizing tank closure assembly of claim 1 wherein:

said connector component and handle are integral with each other and said connector component has outside threads for screwing into the tank and said handle has inside threads; and a sealing plug component having outside threads for screwing into said inside threads of said handle and having inside threads for receiving said hose connector assembly.

4. The unitary pressurizing tank closure assembly of claim 3 wherein:

said handle includes an inside shoulder;

said sealing plug component includes an outside shoulder; and said flexible neck of said bladder being captured between said internal shoulder of said handle and said outside shoulder of said sealing plug component.

5. The unitary pressurizing tank closure assembly of claim 3 wherein:

said sealing plug component includes a neck;

said flexible bladder neck fits over said sealing plug component neck; and said bladder neck further includes a collar for attaching said bladder neck to said sealing plug component neck in a liquid tight seal.

6. The unitary pressurizing tank closure assembly of claim 4 which further includes a seal between said hose connector assembly and said sealing plug component.

7. A portable liquid spraying apparatus comprising:

a tank having a dispensing hose connected thereto and a fill opening at the top thereof;

a sealing cap having a handle, an inwardly projecting throat and a passageway through said throat;

a flexible pressurizing bladder having an opening associated with said inwardly projecting throat and extending into said tank;

a sealing plug for sealing said passageway in said inwardly projecting throat;

a hose connection on said sealing plug for connecting to a pressurized source of water; and a passageway in said sealing plug for connecting said hose connection to said bladder whereby pressurized water may be introduced into said bladder to expand it to pressurize liquid in said tank so that the liquid can be dispensed through said dispensing hose.

8. The portable liquid spraying apparatus of claim 7 wherein:

said pressurizing bladder is made of an elastomeric material.

9. The portable liquid spraying apparatus of claim 7 wherein:

said handle is integral with a connector component affixed to said handle for attaching into said tank; and said sealing plug is connected to said flexible bladder and attached to said handle by a screw connection.

10. The portable liquid spraying apparatus of claim 9 wherein:

said connector component has outside threads for screwing into said tank and said handle has inside threads;

said sealing plug has outside threads for screwing into said inside threads of said handle; and said sealing plug includes a hose connector assembly which is screwed into said sealing plug.

11. The portable liquid spraying apparatus of claim 10 wherein:

said handle includes an inside shoulder;

said sealing plug includes an outside shoulder; and said pressurizing bladder includes a bladder neck ring captured between said handle and said outside shoulder of said sealing plug.

12. The portable liquid spraying apparatus of claim 10 wherein:

said sealing plug includes a neck;

said pressurizing bladder includes a neck ring that fits over said neck; and said neck ring further includes a collar for attaching said neck ring to said neck in a liquid tight seal.

13. The portable liquid spraying apparatus of claim 11 which further includes a seal between said hose connector assembly and said sealing plug.

* * * * *